United States Patent [19]

Golebiewsky

[11] 4,157,765

[45] Jun. 12, 1979

[54] INVIOLABILITY DEVICE FOR CONTAINER HAVING ITS NECK CLOSED BY A SCREW CAP

[75] Inventor: Francois Golebiewsky, Binarville, France

[73] Assignee: Cebal, Clichy, France

[21] Appl. No.: 954,110

[22] Filed: Oct. 24, 1978

[30] Foreign Application Priority Data

Oct. 28, 1977 [FR] France ..... 77 33345

[51] Int. Cl.[2] ..... B65D 41/02; B65D 41/32

[52] U.S. Cl. ..... 220/265; 220/288; 222/541; 222/81; 220/258

[58] Field of Search ..... 220/265, 266, 267, 256, 220/258, 277, 288; 215/344; 222/81, 541

[56] References Cited

U.S. PATENT DOCUMENTS

| | | | |
|---|---|---|---|
| 2,295,865 | 9/1942 | Rentschler | 220/265 |
| 2,317,420 | 4/1943 | Taylor | 220/265 |
| 3,784,045 | 1/1974 | Komendowski | 220/277 |

*Primary Examiner*—George T. Hall

*Attorney, Agent, or Firm*—Dennison, Dennison, Meserole & Pollack

[57] ABSTRACT

An inviolability device which makes it obvious when a container with a screw cap has been opened for the first time. This device comprises a blind tube forming an extension of the neck of the container and being separated therefrom by a weakened zone. The blind tube is broken, at the weakened zone, by an inward driving thereof when the container is opened for the first time. The blind tube and the neck have similar threads thereon with cooperating threads in the screw cap. This device will find particular use in connection with flexible tubes for pharmaceutical or dietetic products.

9 Claims, 1 Drawing Figure

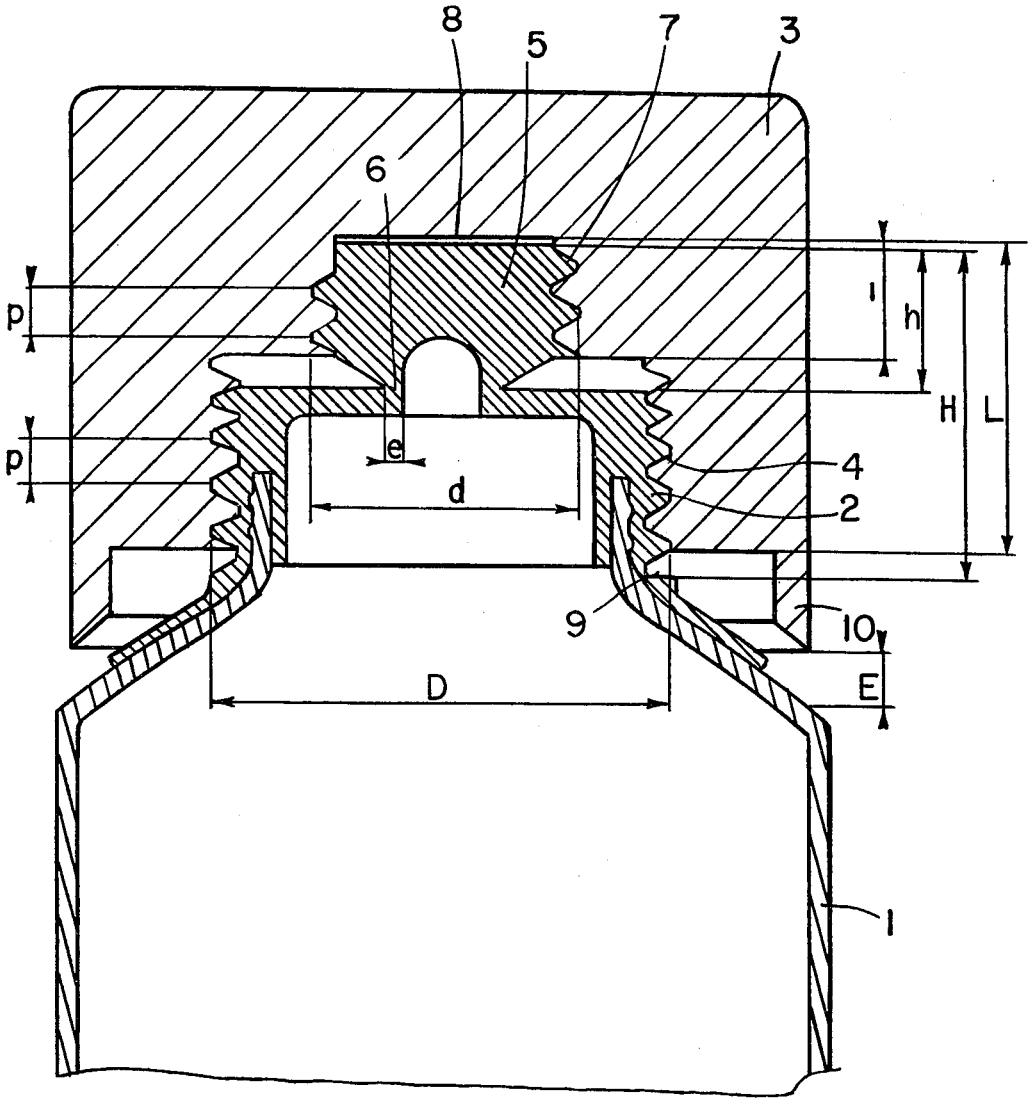
8
5
7
3
6
p
p
l
h
H
L
e
d
4
2
9
10
D
E
1

INVIOLABILITY DEVICE FOR CONTAINER HAVING ITS NECK CLOSED BY A SCREW CAP

The invention relates to an inviolability device for a container having its neck closed by a screw cap.

Various invoilability devices are known which guarantee for the consumer that the container which he is buying has not been opened fraudulently, that the contents have not been polluted or even drawn off and replaced by a worthless product.

Flexible tubes whose plastic necks are blocked by a stopper incorporated in the form of a blind tube are known. The open end of the blind tube is connected to the end of the neck by a zone of smaller strength which can easily be removed by torsion. The closed end of the blind tube has an external diameter corresponding to the internal diameter of the opening made at the end of the neck by rupturing the blind tube. The neck can thus be closed temporarily by turning the stopper and by driving in the closed end of the blind tube.

However, this method of stopping is not completely satisfactory because the foreceful driving of the end of the blind tube into the neck constitutes a very rudimentary method of assembly.

In addition, the end of the stopper could have been polluted by uncontrollable forms of contact.

Screw caps with a peripheral strip or collar which can be fractured along a line of smaller strength are also known.

Inviolability devices consisting of a thin lid made of aluminum stuck on to the opening of the neck are also known. This lid has to be removed or fractured before the contents can be drawn off. This device has the disadvantage of poor visualisation. It makes it necessary to unscrew the protective cap and to carefully examine the lid to check the state of the lid. It makes it necessary for the container manufacturer to perform an additional operation of positioning and sticking the thin lid before screwing the stopper.

Thin plastic lids produced from a single part with the neck also made of plastic are also known but it is not possible to obtain plastic lids of very precise thickness and therefore always of sufficiently small thickness. The plastics are elastic materials which are only slightly malleable. A tool is required for opening such lids.

The object of the present invention is an inviolability device for a container having its neck closed by a screw cap, this neck initially being blocked by a blind tube in the extension of the neck. The open end of this blind tube is connected to the end of the neck by a weakened zone. This weakened zone has an external diameter which is smaller than that of the blind tube. The blind tube is screw-threaded along a screw thread having the same axis and the same pitch as the screw thread of the neck, the threads of the blind tube corresponding to or being in harmony with those of the neck so that neck and blind tube simultaneously screw in a double tapped cap. For this purpose, the cap comprises, in addition to its main tapping which complements the screw-thread of the neck, an auxiliary tapping having the same axis and the same pitch which is complementary to the screw thread of the blind tube. The distance between the bottom of the auxiliary tapping of the cap and the smaller end of its main tapping is smaller than the distance between the end of the blind tube and the bottom of the main tapping of the neck while the depth of the auxiliary tapping is smaller than the height of the blind tube. Thus, when the cap is screwed simultaneously onto the blind tube and the neck, the bottom of the auxiliary screw thread of the cap is first to touch the closed end of the blind tube before the cap is completely screwed onto the neck. The blind tube is then blocked at the bottom of the cap. if screwing is continued, the blind tube is entrained by the cap and is driven into the neck with a helicoidal movement. The weakened zone connecting the blind tube to the end of the neck breaks rapidly as a result of shearing: it is sufficient to continue screwing for about one-third of a turn. In order to allow easy rupturing, the weakened zone of the blind tube has generally been given a thickness of about one-third of that of the wall of the blind tube. This weakened zone corresponds to a peripheral groove which reduces the thickness of material at the level where the blind tube is connected to the neck. The external diameter of the weakened zone is thus smaller than the diameter of the tube and this allows it to penetrate slightly into the neck during the driving-in and shearing operation when screwing of the cap is continued.

The maximum distance between the bottom of the auxiliary tapping and the base of the main tapping of the cap can vary depending upon the elasticity and the brittleness of the materials. It is generally smaller by at least half a screw thread than the distance between the end of the blind tube and the base of the main screw thread of the neck. This allows a screwing operation of at least half a turn once the bottom of the cap has reached the end of the blind tube. The depth of the auxiliary tapping of the cap must also be at least half a thread smaller than the height of the blind tube so that the base of the auxiliary screw thread does not butt against the end of the neck.

The diameter of the blind tube is generally of the order of half the diameter of the neck.

Devices of this type can easily be produced from various plastics such as PVC, polyethylene, polypropylene. They are particularly suitable for the production of heads of metal or plastic flexible tubes.

The invention will be better understood with reference to the description below of a particular example as well as to the attached drawing.

The attached drawing shows the axial section of a head of a flexible tube made of polyethylene which is mounted by means of a ratchet mechanism or by force on a flexible aluminium tube body 1.

The head of the flexible tube 1 comprises at its upper part a screw-threaded neck 2 of conventional shape which is designed to be closed by a cap 3 which is screw-threaded by means of a tapping 4.

The neck 2 of the head is extended by a blind tube 5, the exterior of which is screw-threaded along a screw thread having a diameter which is smaller than that of the neck 2 but which is of the same pitch and whose threads are in harmony. The base of this blind tube 5 is connected to the end of the neck 2 by a weakened zone 6 of reduced diameter both with respect to the external diameter D of the neck 2 and the diameter d of the blind tube 5. This reduction of diameter corresponds to a peripheral groove at the level where the blind tube 5 is connected to the neck 2.

The cap 3 itself comprises two coaxial tappings which are each complementary with a screw thread of the head. The main tapping 4 of the cap allows it to be screwed onto the neck 3. The auxiliary tapping 7 has a diameter d corresponding to that of the screw thread of the blind tube 5; its depth 1 is smaller than the height h of the blind tube 5. The diameter D of the main tapping 4 corresponds to that of the screw thread of the neck. The distance L between the bottom S of the auxiliary tapping 7 and the base of the main tapping 4 is smaller than the distance H between the end of the blind tube 4 and the base 9 of the main screw thread of the neck 2. Thus, when the cap 3 is first screwed on to the head of the flexible tube before the contents are used, the two tappings 4 and 7, of the same pitch and whose threads correspond or are in harmony, screw simultaneously on to the neck 2 and the blind tube 5. The end of the blind tube 5 butts first against the bottom 8 of the auxiliary tapping 7 before the cap is screwed completely to the base 9 of the neck 2. The only important factor during this first screwing operation is that a limited stress be exerted so that the screwing operation stops without forcing as soon as the bottom 8 of the auxiliary tapping butts against the end of the blind tube 5.

The screwing operation is forced slightly in order to make a perforation in the neck and to be able to use the contents of the container. The screwing operation can take place on the neck 2 owing to the tapping 4 but not on the tube 5 which butts against the bottom 8. The tube 5 is entrained by the helicoidal displacement of the cap 3 which continues to be screwed on to the neck 2. The weakened zone 6 is driven lightly into the end of the neck 2 by bending and by receiving a torsional stress. The weakened zone 6 breaks easily as a result of shearing without the necessity of continuing screwing for more than about one-third of a turn, thus creating the desired perforation at the end of the neck 2.

It is easy to understand that for this operation to be possible it is important for the cap 3 to be screwed not to butt against the base 9 of the main screw thread of the neck 2 or on the end of the neck itself before the weakened zone 6 has been subjected to a sufficient torsional-shearing stress. In more simple terms, it is important for $H>L$, that is to say, in practice: $H-L>$, (p/2); at the same time as $h-l \# H-L$.

It is also to be understood that if the cap 3 comprises, for esthetic reasons or for reasons of simplicity in stacking, a skirt 10 having the same external diameter as the flexible tube 1 it is important to provide a clearance E between the base of the skirt and the shoulder of the flexible tube. The following equation should be substantially satisfied: $E \# H-L$.

This device is therefore particularly simple to use. The cap 3 is screwed simultaneously on to the neck 2 and the blind tube 5 until the end of the blind tube 5 butts without force against the bottom 8 of the auxiliary tapping 7.

The head of the tube with its cap 3 in place is mounted on the flexible tube 1. The tube 1 is filled through the base with consumer product. According to the conventional process with flexible tubes, the base of the tube 1 is sealed immediately after filling and is despatched to a distributor. It is easy for the distributor to observe that the tube has not been opened fraudulently by merely checking the clearance E between the skirt 10 and tube head or the clearance (H−L) between the base of the main tapping 4 of the cap and the base 9 of the main screw thread of the neck without even having to unscrew the cap completely. The cap can also be unscrewed completely without damaging the inviolability device in any way.

When the consumer wishes to use the contents, he forces the screwing of the cap 3 by about one-third of a turn. The weakened zone 6 breaks easily. By subsequently unscrewing the cap 3 the blind tube 5 remains blocked against the bottom of the cap. During subsequent replacement of the stopper, the base of the blind tube 5 will act at the level of the weakened zone 6 as a gasket on the neck. It has not been possible for the base of the blind tube 5 to be polluted by any external element.

In the example shown, the head of the flexible tube with its neck 2 and its blind tube 5 are made of polypropylene like the cap 3. The tube 1 is made of aluminium.

The dimensions of the elements of the head of the tube are substantially as follows:

| | | | |
|---|---|---|---|
| d = 9 mm | D = 15 mm | e = 0.5 mm | E = 1.5 mm |
| p = 1.5 mm | I = 3 mm | L = 9 mm | |
| h = 4.5 mm | H = 10.5 mm | | |

The tube 1 could be made equally well of plastic or of a metallo-plastic complex.

I claim:

1. In an inviolability device for a container having a neck with an orifice therethrough and an external screw thread, a blind tube having an external screw thread and blocking the orifice, the open end of said blind tube being connected to the end of the neck by a weakened zone having a diameter which is smaller than that of the blind tube, a screw cap comprises a double tapping, a main tapping which complements the screw thread of the neck and an auxiliary tapping which complements the screw thread of the blind tube, the two tappings have the same axis and the same pitch and their associated threads being in harmony therewith, thus allowing the tappings to be screwed simultaneously, the distance (L) between the bottom of the auxiliary tapping and the base of the main tapping is smaller than the distance (H) between the end of the blind tube and the base of the screw thread of the neck, while the depth (l) of the auxiliary tapping is smaller than the height (h) of the blind tube, the cap screwing simultaneously on to the neck and the blind tube and butting first with the bottom of its auxiliary tapping against the closed end of the blind tube.

2. A device according to claim 1, wherein the thickness of the weakened zone is substantially one-sixth of the thickness of the wall of the blind tube.

3. A device according to any one of claims 1 or 2, wherein the values (H−L) and (h−l) are both at least equal to one-half of the pitch of the screw threads (p/2).

4. A device according to claim 3 wherein the external diameter (d) of the blind tube is substantially equal to half the diameter (D) of the neck.

5. A device according to claim 4 wherein the neck of the container and the cap are made of plastic such as polypropylene, polyethylene, or PVC.

6. A device according to claim 5 wherein the container comprises a metal tube, the neck of the container being forcefully fitted on the metal tube.

7. A device according to claim 5 wherein the container comprises a flexible tube body of plastic-like material, the neck of the container being molded or welded on to the flexible tube body.

8. A process for the opening of an inviolability devie on a necked container which is closed by a screw cap and whose neck orifice is initially blocked by the inviolability device which includes a blind tube whose open end is connected to the end of the neck by a weakened zone of reduced diameter, the process comprising the fixing of the blind tube in the bottom of the cap and the application of torsion to the cap and the driving of the blind tube into the neck at the weakened zone.

9. A device according to claim 1 wherein the external diameter (d) of the blind tube is substantially equal to half the diameter (D) of the neck.

* * * * *